US006739426B2

(12) United States Patent
Sherikar et al.

(10) Patent No.: US 6,739,426 B2
(45) Date of Patent: May 25, 2004

(54) LOW-NOISE PRESSURE REDUCTION SYSTEM

(75) Inventors: Sanjay V. Sherikar, Mission Viejo, CA (US); Laurence R. Stratton, Anaheim, CA (US)

(73) Assignee: Control Components, Inc., Rancho Santa Margarita, CA (US)

( * ) Notice: Subject to any disclaimer, the term of this patent is extended or adjusted under 35 U.S.C. 154(b) by 0 days.

(21) Appl. No.: 10/316,554

(22) Filed: Dec. 11, 2002

(65) Prior Publication Data

US 2003/0221906 A1 Dec. 4, 2003

Related U.S. Application Data

(60) Provisional application No. 60/384,766, filed on May 31, 2002.

(51) Int. Cl.[7] ..... F01N 7/08; F01N 1/24

(52) U.S. Cl. ..... 181/248; 181/230; 181/258

(58) Field of Search ..... 181/248, 230, 181/258, 251, 252, 256, 222, 247, 249

(56) References Cited

U.S. PATENT DOCUMENTS 2,073,951 A * 3/1937 Servais ..... 181/252
3,175,640 A * 3/1965 Matsui ..... 181/252
3,561,561 A * 2/1971 Trainor ..... 181/267
3,957,133 A * 5/1976 Johnson ..... 181/256
4,134,472 A * 1/1979 Trainor ..... 181/258
6,209,678 B1 * 4/2001 Sterling ..... 181/230
6,354,398 B1 * 3/2002 Angelo et al. ..... 181/256

* cited by examiner

*Primary Examiner*—Robert Nappi
*Assistant Examiner*—Edgardo San Martin
(74) *Attorney, Agent, or Firm*—Stetina Brunda Garred & Brucker

(57) ABSTRACT

Disclosed is a diffuser apparatus for facilitating a reduction in fluid pressure and suppression of noise. The apparatus comprises a tubular inner sleeve, a tubular muffler and a tubular outer sleeve. The inner sleeve defines a fluid flow axis and has a plurality of inner sleeve passages. The outer sleeve has the inner sleeve concentrically positioned therein and defines a plurality of outer sleeve passages. The muffler is concentrically positioned between the inner and outer sleeves such that fluid flows radially outwardly through the inner sleeve passages, through the muffler, and through the outer sleeve passages. The muffler may be spaced from the inner sleeve so as to define a gap between the muffler and the inner sleeve. The muffler may also be spaced from the outer sleeve so as to define a gap between the muffler and the outer sleeve.

14 Claims, 4 Drawing Sheets

LOW-NOISE PRESSURE REDUCTION SYSTEM

CROSS-REFERENCE TO RELATED APPLICATIONS

The present application claims priority to U.S. Provisional Application Serial No. 60/384,766 entitled LOW-NOISE PRESSURE REDUCTION SYSTEM filed May 31, 2002.

STATEMENT RE: FEDERALLY SPONSORED RESEARCH/DEVELOPMENT (Not Applicable)

BACKGROUND OF THE INVENTION

The present invention relates generally to the art of acoustics, and more particularly to a diffusion apparatus which is adapted to facilitate a reduction of pressure in a fluid flow while simultaneously suppressing or silencing jet velocity noise by eliminating the noise-generating sources created by the flow.

For many years, vent silencers and diffusers have been employed in various industries to muffle high velocity air or gas, including steam, flowing to the atmosphere. For example, vent silencers are often used in conjunction with the safety valves employed in high pressure, high temperature steam service for relieving over pressure from steam generating equipment. In this regard, it is not uncommon for the discharge from such high capacity safety valves to achieve sonic or near sonic velocity in the discharge duct leading to atmosphere such that the duct flow transmits the noise created at the valve, as well as the noise generated as a result of the discharge of the flow to atmosphere. Various federal regulations have been created which stringently regulate the noise level which may be generated by such discharging safety valves. As a result, there has been developed in the prior art various types of vent or blowoff silencers and diffusers which are adapted to muffle a sonic gas, steam, or air stream. In the prior art, vent silencers are often used in an approach known as the "path treatment" of noise. In the path treatment approach, noise-generation is allowed to take place, with the noise-absorbing elements of the vent silencer being operative only to absorb the noise that has already physically been generated. Many currently known vent silencers achieve noise reduction through the use of elements such as wire-mesh, metal foam, or mineral wool acoustic cladding.

An alternative approach to noise reduction is known as "source treatment". The source treatment approach relies on reducing the strength of the source of noise by various means, including the control or reduction of fluid velocity. Currently known diffusers are often used in source treatment applications, and include wire meshes, metal foam, or equivalents which are placed into the flow path of the gas, steam or air jet in such a way that the noise-generating mechanisms are weakened to a point that a high degree of noise reduction is achieved.

In current vent silencer and diffuser designs, features are included to facilitate a reduction in the flow velocity at the entrance to the wire mesh or other noise reducing elements. More particularly, the flow is typically channeled through a first pressure-reducing stage to facilitate a pressure-drop to critical or near-critical values. In some vent silencer and diffuser designs, when the pressure drop requirement is very high, an additional pressure drop stage is introduced at the inlet without the treatment of the resulting supersonic jet(s) and without any wire meshes or other noise reducing/sound absorbing elements before introduction into the next stage (s). In this respect, only the downstream stage(s) that follow have elements to muffle the noise that has been generated.

Though generally suitable for achieving noise reduction either through noise absorption in a path treatment application or velocity control/pressure reduction in a source treatment application, prior art vent silencers and diffusers possess certain deficiencies which detract from their overall utility. Perhaps the most significant of these deficiencies is the current practice of placing the wire mesh or other noise reduction elements directly at (i.e., in direct contact with) the outlets and/or inlets of the flow openings or passages within the pressure reducing stages. Such placement often results in blockage at the outlets of the flow openings when solids are present in the flow stream larger than the openings in the wire mesh or its functional equivalent. The placement of the noise reduction element directly at the inlet end of a flow opening of another pressure reducing stage results in an efficiency decrease in the losses which would otherwise be achieved if flow to the inlet end was unrestricted.

The present invention addresses these deficiencies by providing a diffuser apparatus which falls within the source treatment category and is adapted to facilitate noise reduction through a reduction of peak velocity at the outlet of a pressure reduction flow path.

BRIEF SUMMARY OF THE INVENTION

The diffuser apparatus of the present invention is adapted for use in conjunction with highly underexpanded jets. If allowed to expand freely when exiting from a flow opening or passage, these underexpanded jets facilitate supersonic flow with resultant noise producing shockwaves downstream of the sleeve passage exit or outlet. The diffuser of the present invention facilitates noise reduction via a reduction of peak velocity at the outlet of a pressure reduction sleeve passage through the use of wire mesh, metal foam or other noise-absorbing elements in conjunction with a straight or tortuous pressure reducing sleeve passage. The use of the wire meshes, metal foam or their functional equivalents in accordance with the present invention makes the flow more uniform at the outlet of the sleeve passage, thereby reducing the magnitude of the velocity peak. Since noise is strongly related to velocity, the reduction in the peak velocity in turn achieves a reduction in noise.

In the diffuser apparatus of the present invention, the wire mesh or its functional equivalents used to eliminate the noise sources in the flow is oriented within the apparatus so that the outlets and/or inlets of the sleeve passage(s) within the pressure reducing stage(s) are unrestricted. The lack of any restriction at the outlet(s) of the sleeve passage allows for the passage of any solids in the fluid stream out of the jet exit with the flow. This feature has no significant impact on the function of noise reduction due to the manner in which a shock wave is produced by the jet emanating from the outlet of the sleeve passage. The lack of any restriction at the inlet end of the sleeve passage(s) of a downstream pressure reducing stage effectively maintains the level of inlet losses achieved as a result of flow into such sleeve passage(s).

BRIEF DESCRIPTION OF THE DRAWINGS

These, as well as other features of the present invention, will become more apparent upon reference to the drawings wherein.

DETAILED DESCRIPTION OF THE INVENTION

Figure 1:
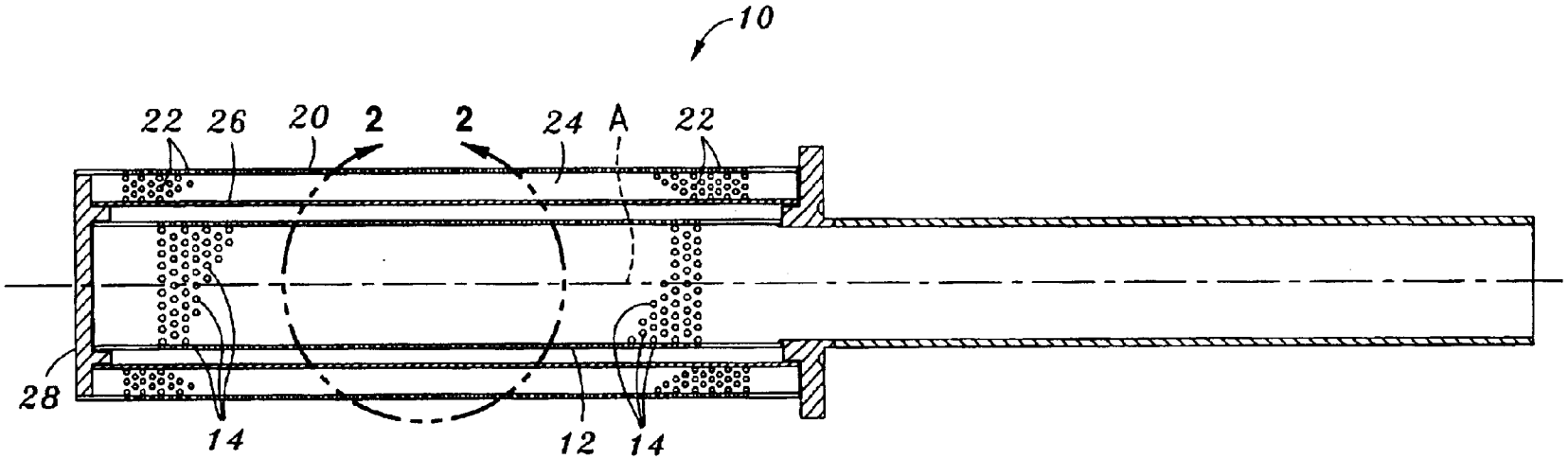
FIG. 1 is a cross-sectional view of a diffuser apparatus constructed in accordance with a first embodiment of the present invention.
Figure 2:
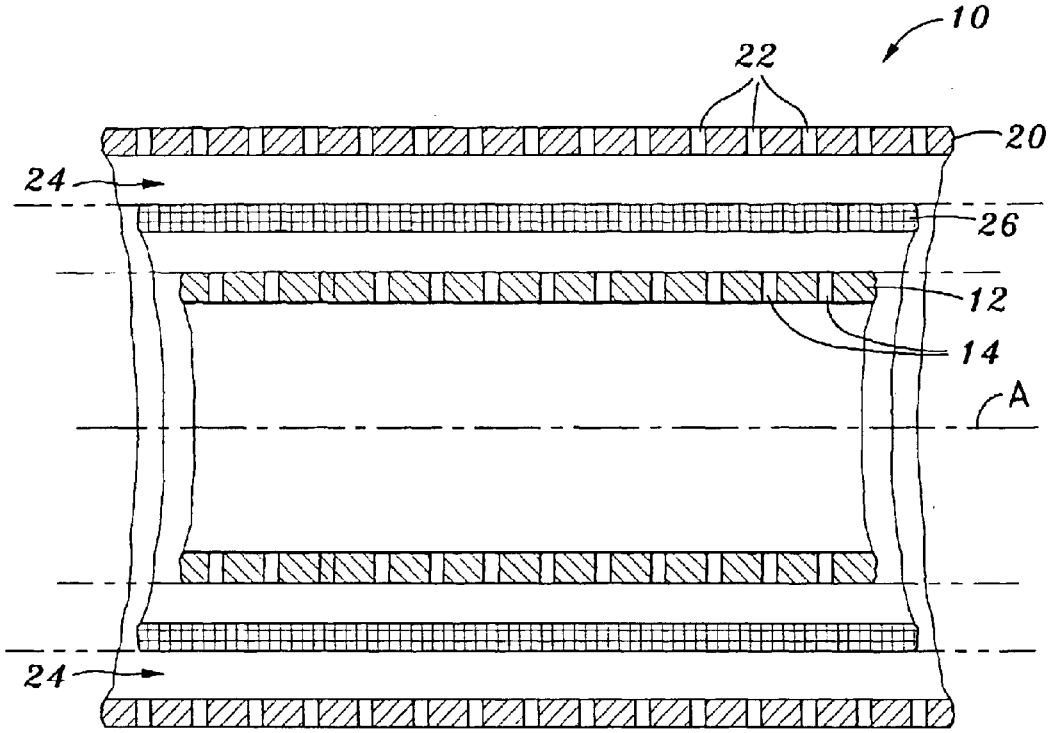
FIG. 2 is a partial cross-sectional view of the encircled region 2—2 of the diffuser apparatus shown in FIG. 1.

Referring now to the drawings wherein the showings are for purposes of illustrating preferred embodiments of the present invention only, and not for purposes of limiting the same, FIGS. 1 and 2 illustrate in cross-section a flow distributor or diffuser apparatus 10 constructed in accordance with a first embodiment of the present invention. The diffuser apparatus 10 comprises an elongate, tubular inner pipe or sleeve 12 which defines a longitudinal fluid flow axis A. The tubular inner sleeve 12 may have a cylindrical shape. Disposed within the inner sleeve 12 are a multiplicity of generally straight flow openings or passages 14. Though only a relatively small number of the inner sleeve passages 14 are depicted in FIGS. 1 and 2, it will be recognized that the inner sleeve passages 14 are disposed within a substantial portion of the length of the inner sleeve 12. Each of the inner sleeve passages 14 extends along an axis which itself extends radially from the axis A. Each of the inner sleeve passages 14 defines an outlet end which extends to the outer surface of the inner sleeve 12, and an inlet end which fluidly communicates with the interior of the inner sleeve 12 (i.e., extends to the inner surface of the inner sleeve 12).

Figure 6:
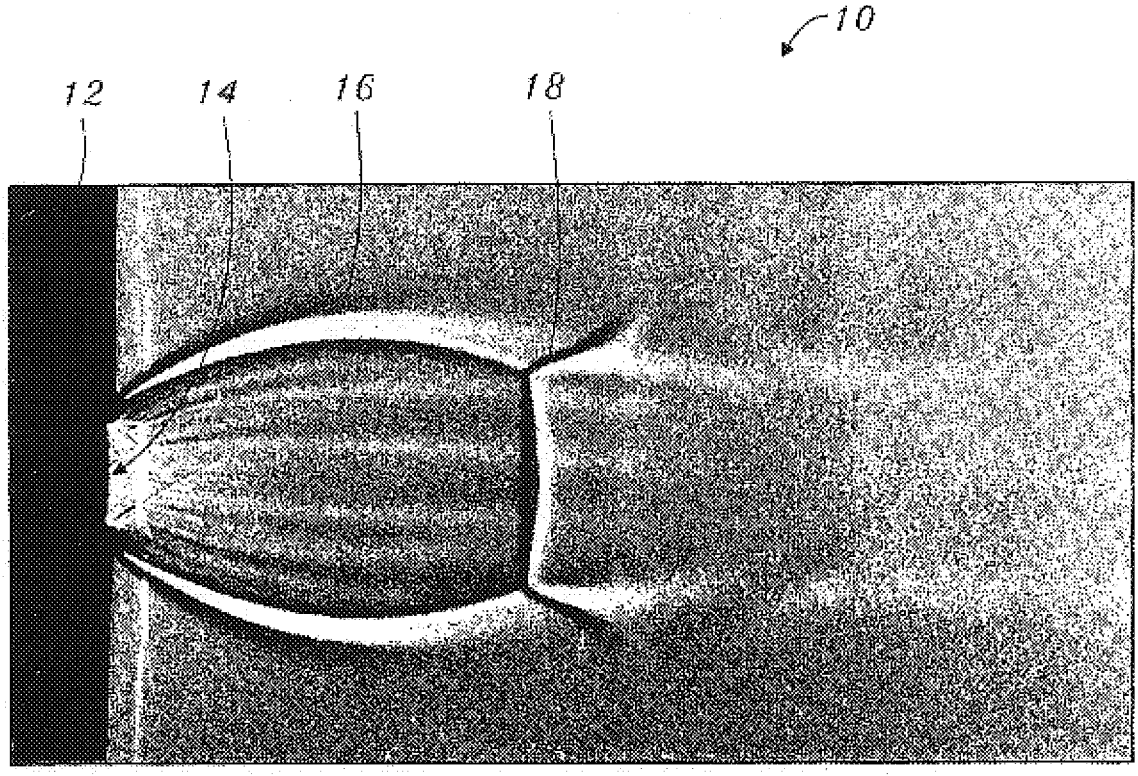
FIG. 6 is a drawing depicting the manner in which a noise producing shockwave is generated by an under expanded jet emanating from a sleeve passage within the diffuser apparatus of the first, second or third embodiments of the present invention.

Referring now to FIG. 6, the introduction of a high pressure fluid such as steam into the interior of the inner sleeve 12 facilitates the formation of an underexpanded jet 16 which emanates from the outlet end of the inner sleeve passage 14 and accelerates to supersonic speed. Once exiting the outlet end of the inner sleeve passage 14, the jet 16 begins to freely expand, resulting in the eventual formation of a shockwave 18 downstream of the inner sleeve passage 14. As will be recognized, the generation of the shockwave 18 in turn results in the production of extremely high noise levels. Other phenomena associated with supersonic jet 16 velocities also contribute to the high noise levels. The diffuser apparatus 10 of the present invention is specifically designed to prevent such shockwave 18 from being generated and to suppress the noise generated due to the other phenomena in a manner which will be described in more detail below.

In addition to the inner sleeve 12, the diffuser apparatus 10 of the first embodiment comprises an elongate, tubular outer pipe or sleeve 20 which itself includes a multiplicity of generally straight outer sleeve passages 22 disposed therein. The outer sleeve 20 may also have a cylindrical shape. Like the inner sleeve passages 14, the outer sleeve passages 22 each preferably extend along an axis which itself extends radially from the axis A. In this regard, the inner sleeve 12 is preferably concentrically positioned within the outer sleeve 20 such that an annular space or gap 24 is defined therebetween. The gap 24 is partially defined by the inner surface of the outer sleeve 20 and the outer surface of the inner sleeve 12, with both the inner sleeve passages 14 and the outer sleeve passages 22 fluidly communicating with the gap 24.

The diffuser apparatus 10 of the first embodiment further comprises a tubular noise attenuator or muffler 26 which is disposed within the gap 24 between the inner and outer sleeves 12, 20. Like the inner sleeve 12 and the outer sleeve 20, the muffler 26 may also have a cylindrical shape. In this regard, the inner sleeve 12 is preferably concentrically positioned within the muffler 26, which is itself concentrically positioned within the outer sleeve 20. During operation of the diffuser apparatus 10, fluid flows radially outwardly through the inner sleeve passages 14, through the muffler 26, and through the outer sleeve passages 22. It is contemplated that the inner sleeve passages 14 may be axially aligned with the outer sleeve passages 22. By arranging the inner and outer sleeve passages 14, 22 in this manner, the flow of the fluid exiting the inner sleeve passages 14 may readily enter the outer sleeve passages 22 after passing through the muffler 26. It is also contemplated that the inner sleeve passages 14 may be axially offset from the outer sleeve passages 22. By axially offsetting the inner sleeve passages 14 from the outer sleeve passages 22, a further reduction in the noise may be effected.

The muffler 26 is preferably fabricated from a noise absorbing or reducing material, such as wire mesh or metal foam. If fabricated from wire mesh, it is contemplated that the muffler 26 will be assembled by wrapping a sheet of wire mesh about a cylindrically configured mandrel, and thereafter removing the mandrel from within the wire mesh upon the completion of the wrapping process. As will be recognized, the thickness of such muffler 26 can be varied according to the number of wraps of the wire mesh about the mandrel. Whether the muffler 26 is fabricated from the wire mesh material, metal foam, or any other noise reduction material, the thickness of the muffler 26 can be varied, and selected based upon a particular application. Along these lines, the particular material selection for the muffler 26 will also be dependent upon the application, as may other parameters such as mesh size (if wire mesh is used as the noise reducing material) or porosity (if metal foam is used as the noise reducing material).

In the diffuser apparatus 10 of the first embodiment, the muffler 26 is disposed within the gap 24 so as to extend in spaced relation to the outer surface of the inner sleeve 12, and in spaced relation to the inner surface of the outer sleeve 20 so as to define a gap between the muffler 26 and the respective outer and inner surfaces of the respective inner and outer sleeves 12, 20. The orientation of the muffler 26 in spaced relation to the inner sleeve 12 eliminates the blockage problem described above, in that the absence of any restriction at the outlet ends of the inner sleeve passages 14 allows solids in the fluid stream to flow out of the outlet ends and into the space between the inner sleeve 12 and the muffler 26. As will be recognized, if the muffler 26 was in direct contact with the outer surface of the inner sleeve 12, a solid passing through any inner sleeve passage 14 could create a blockage therein if the size of the solid was such that it would not pass through the mesh openings or pores of the muffler 26. Applicant has determined that such spacing does not compromise the noise attenuation or reduction capabilities of the diffuser apparatus 10 since, as shown in FIG. 6, the shock wave 18 is not created until the jet 16 begins to expand upon emanating from the outlet end of the inner sleeve passage 14. The muffler 26 is preferably positioned so that the jet 16 impinges the same prior to expanding to a point whereat the shock wave 18 is created. Those of ordinary skill in the art will recognize that the inner sleeve 12 of the diffuser apparatus 10 functions as a first pressure-reducing stage in that a pressure drop across the inner sleeve 12 is created as a result of the flow of the high pressure fluid (e.g., steam) through the inner sleeve passages 14.

After flowing outwardly through the inner sleeve passages 14 and through the muffler 26, the high pressure fluid flows into and through the outer sleeve passages 22 of the outer sleeve 20. In this regard, the outer sleeve 20 functions as a second pressure-reducing stage downstream of the first pressure-reducing stage created by the inner sleeve 12. Applicant has further determined that the level of inlet loss (and hence pressure reduction) facilitated by the flow of fluid into the inlet ends of the outer sleeve passages 22 is maximized by allowing such flow to occur in an unrestricted manner. Maintaining the muffler 26 in spaced relation to the inner surface of the outer sleeve 20 and hence in spaced relation to the inlet ends of the outer sleeve passages 22 facilitates such unrestricted flow thereinto. Thus, the pressure reducing efficiency of the outer sleeve 20 is maximized.

Figure 3:
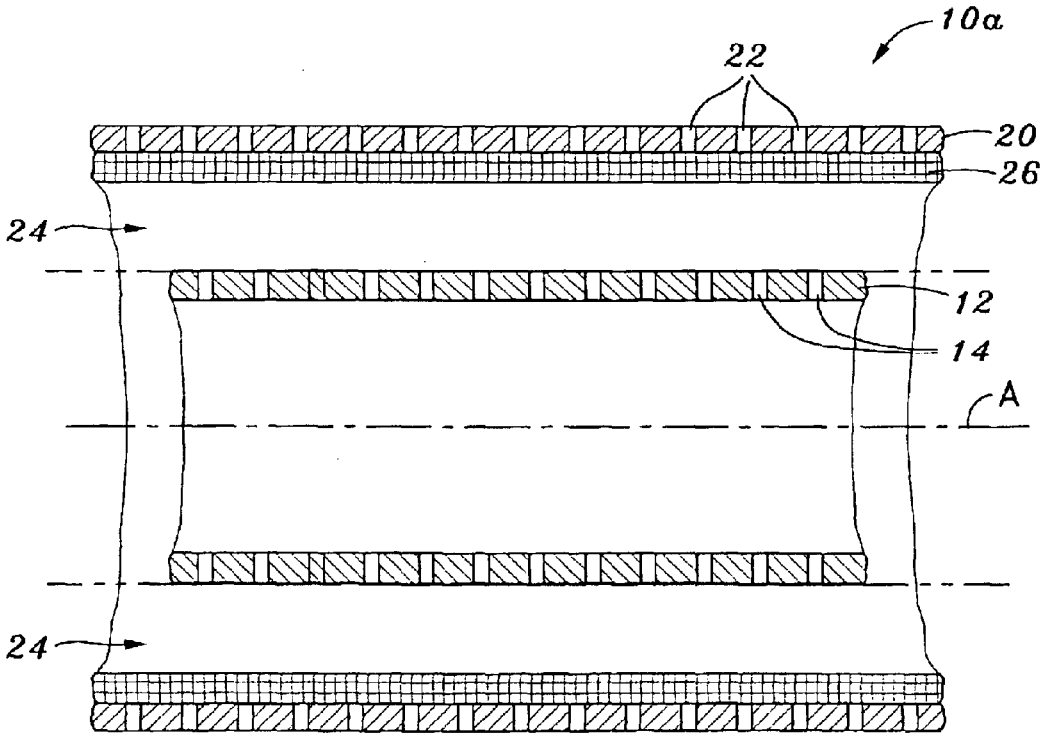
FIG. 3 is a partial cross-sectional view of a diffuser apparatus constructed in accordance with a second embodiment of the present invention.
Figure 4:
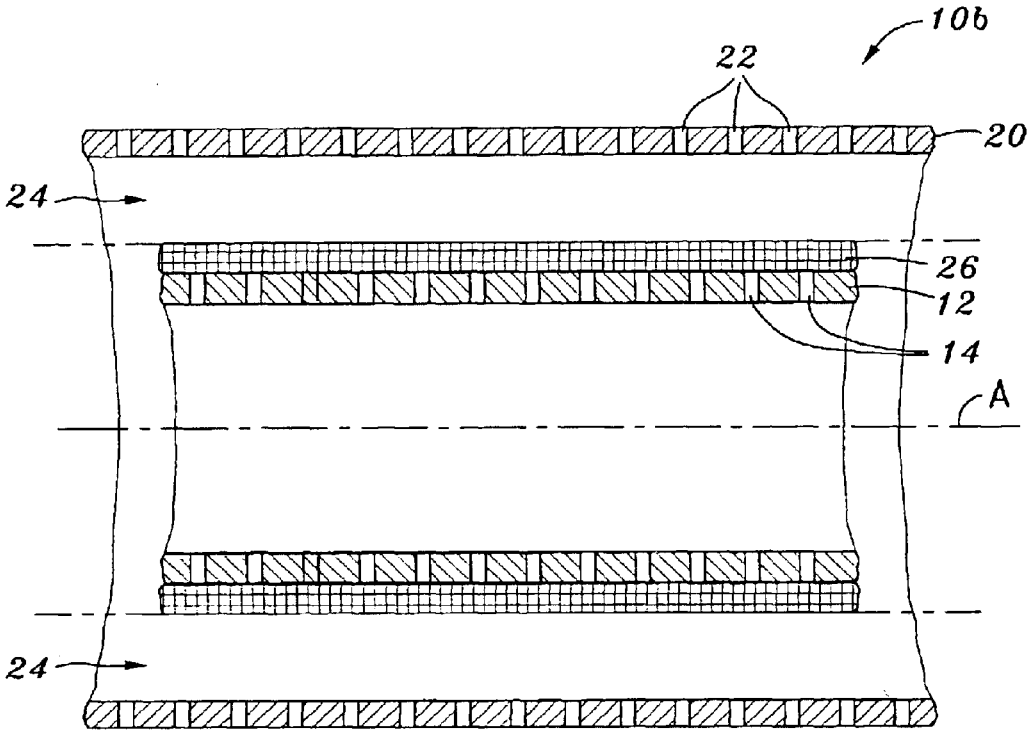
FIG. 4 is a partial cross-sectional view of a diffuser apparatus constructed in accordance with a third embodiment of the present invention.

Referring now to FIG. 3, there is shown a portion of a diffuser apparatus 10*a* constructed in accordance with a second embodiment of the present invention. The diffuser apparatus 10*a* is virtually identical to the diffuser apparatus 10 of the first embodiment described above, except that the muffler 26 of the diffuser apparatus 10*a* is in direct contact with the inner surface of the outer sleeve 20. Thus, the diffuser apparatus 10*a* of the second embodiment provides the above-described advantages attributable to the spacing between the muffler 26 and the outer surface of the inner sleeve 12, but does not impart the advantages attendant to the spacing between the muffler 26 and the inner surface of the outer sleeve 20. FIG. 4 partially depicts a diffuser apparatus 10*b* constructed in accordance with a third embodiment of the present invention wherein the muffler 26 is in direct contact with the outer surface of the inner sleeve 12, but is disposed in spaced relation to the inner surface of the outer sleeve 20. As a result, the diffuser apparatus 10*b* of the third embodiment provides the above-described advantages attendant to the spacing between the muffler 26 and inner surface of the outer sleeve 20, but not those attributable to the spacing between the muffler 26 and the outer surface of the inner sleeve 12.

The placement of the muffler 26 in spaced relation to both the inner and outer sleeves 12, 20 as described in relation to the diffuser apparatus 10 of the first embodiment provides the added advantage of allowing for the selective, periodic replacement of the muffler 26. In this regard, if the muffler 26 is not attached or engaged to either the inner sleeve 12 or outer sleeve 20, the muffler 26 could be periodically removed from within the gap 24 between the inner and outer sleeves 12, 20 and replaced with a new muffler 26. Such replacement may be desirable since the flow capacity through the muffler 26 could be diminished over time by the entrapment of solids therein. The muffler 26 could be accessed by the removal of an end cap 28 enclosing common ends of the inner and outer sleeves 12, 20. The end cap 28 may sealed to the inner and outer sleeves 12, 20 for blocking fluid flowing along the axis A of the inner sleeve 12 such that the fluid passes radially outwardly through the inner and outer sleeve passages 14, 22.

Figure 5:
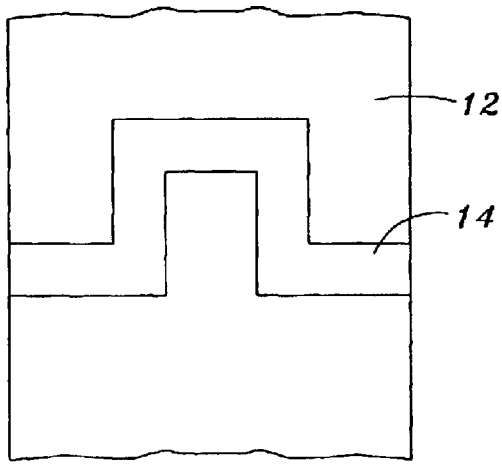
FIG. 5 is a partial cross-sectional view of the diffuser apparatus of either the first, second or third embodiments of the present invention, illustrating an alternatively configured sleeve passage therein.

As indicated above, the inner and outer sleeves 12, 20 each function as a pressure-reducing stage, with a pressure drop being facilitated by the flow of high pressure fluid through the inner and outer sleeve passages 14, 22. As seen in FIG. 5, it is contemplated that the inner sleeve passages 14 of the inner sleeve 12 need not necessarily have a generally straight configuration, but may alternatively have a tortuous configuration defined by multiple turns or other geometries, thus providing a higher level of pressure reduction. Though not shown, it will be recognized that the outer sleeve passages 22 of the outer sleeve 20 may also be formed to have tortuous configurations. The tortuous configurations of the inner and outer sleeve passages 14, 22 may define a series of at least four right-angle turns.

Though the diffuser apparatuses 10, 10*a*, 10*b* are each shown as including only the inner and outer sleeves 12, 20 having the muffler 26 therebetween, those of ordinary skill in the art will recognize that one or more additional pressure-reducing stages may be included without departing from the spirit and scope of the present invention. For example, if dictated by need in accordance with the fluid pressure level, the outer sleeve 20 could itself be concentrically positioned within yet another sleeve or a further sleeve having further sleeve passages therewithin. The further sleeve passages may extend radially through the further sleeve in relation to the flow axis and may be configured to allow the fluid to flow therethrough to escape the further sleeve after escaping the outer sleeve. A second or further muffler 26 may be positioned in the gap defined between the outer sleeve 20 and such additional sleeve at a spacing from the outer surface of the outer sleeve 20 as needed to prevent the formation of a shockwave 18. This arrangement could be repeated as needed to achieve the desired pressure and noise reduction levels. In addition, one or more additional or further mufflers 26 may be disposed concentrically without the outer sleeve 20 such that fluid passes through the additional mufflers 26 before exiting directly into the atmosphere. In an arrangement having a further muffler 26, it is contemplated that a plurality of jets 16 may be defined by the fluid escaping the outer sleeve 20. The further muffler 26 may be disposed in spaced relation to the outer sleeve 20 such that the jets 16 impinge upon the further muffler 26 prior to creating shockwaves.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. An apparatus for facilitating a reduction in fluid pressure and suppression of noise created by the reduction of fluid pressure, the apparatus comprising:

a tubular inner sleeve defining a fluid flow axis and a plurality of inner sleeve passages extending radially therethrough relative to the axis, each of the inner sleeve passages having a tortuous configuration;

a tubular outer sleeve having the inner sleeve concentrically positioned therein, the outer sleeve defining a plurality of outer sleeve passages extending radially therethrough relative to the axis; and a tubular muffler concentrically positioned between the inner and outer sleeves;

wherein fluid flows radially outwardly through the inner sleeve passages, through the muffler, and through the outer sleeve passages, the muffler being oriented relative to the inner sleeve such that jets forming downstream of the inner sleeve passages will impinge the muffler prior to creating shockwaves.

2. The apparatus of claim 1, wherein the muffler is disposed in spaced relation to the inner sleeve such that a gap is defined therebetween.

3. The apparatus of claim 1, wherein the muffler is disposed in spaced relation to the outer sleeve such that a gap is defined therebetween.

4. The apparatus of claim 1, wherein the muffler is disposed in spaced relation to the inner and outer sleeves such that gaps are defined therebetween.

5. The apparatus of claim 1, wherein each of the inner sleeve passages define at least four right-angle turns.

6. An apparatus for facilitating a reduction in fluid pressure and suppression of noise created by the reduction of fluid pressure, the apparatus comprising:

a tubular inner sleeve defining a fluid flow axis and a plurality of inner sleeve passages extending radially therethrough relative to the axis;

a tubular outer sleeve having the inner sleeve concentrically positioned therein, the outer sleeve defining a plurality of outer sleeve passages extending radially therethrough relative to the axis, each of the outer sleeve passages having a tortuous configuration;

a tubular muffler concentrically positioned between the inner and outer sleeves;

wherein fluid flows radially outwardly through the inner sleeve passages, through the muffler, and through the outer sleeve passages, the muffler being oriented relative to the inner sleeve such that jets forming downstream of the inner sleeve passages will impinge the muffler prior to creating shockwaves.

7. The apparatus of claim 6, wherein each of the outer sleeve passages define at least four right-angle turns.

8. The apparatus of claim 1, wherein the muffler is fabricated from wire mesh.

9. The apparatus of claim 1, wherein the muffler is fabricated from metal foam.

10. The apparatus of claim 1, further comprising an end cap disposed in sealing engagement to the inner and outer sleeves for blocking fluid flowing along the axis such that the fluid passes radially outwardly through the inner and outer sleeve passages.

11. The apparatus of claim 1, wherein the inner sleeve passages are radially aligned with respective ones of the outer sleeve passages.

12. The apparatus of claim 1, wherein the inner sleeve passages are axially offset from the outer sleeve passages.

13. A method of inhibiting the formation of shockwaves resulting from fluid flowing through a diffusion apparatus, the method comprising the steps of:

providing a tubular inner sleeve having a plurality of radially extending inner sleeve passages of tortuous configuration through which fluid may flow radially outwardly such that jets form downstream of the inner sleeve passages;

allowing the jets to freely expand downstream of the inner sleeve passages; and concentrically positioning a tubular muffler relative to the inner sleeve such that the jets impinge the muffler prior to creating shockwaves.

14. The method of claim 13 further comprising the step of disposing the muffler in spaced relation to the inner sleeve such that a gap is defined therebetween.

* * * * *